US005622426A

United States Patent [19]

Romano et al.

[11] Patent Number: 5,622,426

[45] Date of Patent: Apr. 22, 1997

[54] WASH LIGHT AND METHOD

[76] Inventors: Richard J. Romano, 2478 Peacock La., Corona, Calif. 91720; Robert A. Fry, 22265 Tiburon St., Laguna Hills, Calif. 92653

[21] Appl. No.: 431,855

[22] Filed: May 1, 1995

Related U.S. Application Data

[63] Continuation-in-part of Ser. No. 350,094, Nov. 29, 1994, abandoned, and Ser. No. 383,892, Feb. 6, 1995, abandoned.

[51] Int. Cl.[6] ..... F21P 3/00

[52] U.S. Cl. ..... 362/281; 362/293; 362/426

[58] Field of Search ..... 362/263, 287, 362/293, 386, 383, 286, 428, 371, 281, 426

[56] References Cited

U.S. PATENT DOCUMENTS

| | | | |
|---|---|---|---|
| 1,680,685 | 8/1928 | King | 362/386 |
| 1,747,279 | 2/1930 | Andreino | 362/368 |
| 3,665,179 | 5/1972 | McLintic | 362/293 |
| 3,932,033 | 1/1976 | Osborn et al. | 352/228 |
| 4,890,208 | 12/1989 | Izenour | 362/293 |
| 4,894,760 | 1/1990 | Callahan | 362/293 |
| 5,073,847 | 12/1991 | Bornhorst | 362/293 |
| 5,416,681 | 5/1995 | Wu | 362/293 |

*Primary Examiner*—James C. Yeung
*Assistant Examiner*—Sara Sachie Raab

[57] ABSTRACT

A simple, reliable and yet fully capable wash light, having a lamp surrounded by a reflector, a field stop with a fixed aperture, a frame for holding color/diffusion/dowser panels, and a fernal lens located immediately adjacent the frame. These elements are mounted in a housing which, in turn, is mounted to a yoke allowing 270 degrees of tilt. The yoke is mounted to a base allowing 360 degrees of pan.

8 Claims, 2 Drawing Sheets

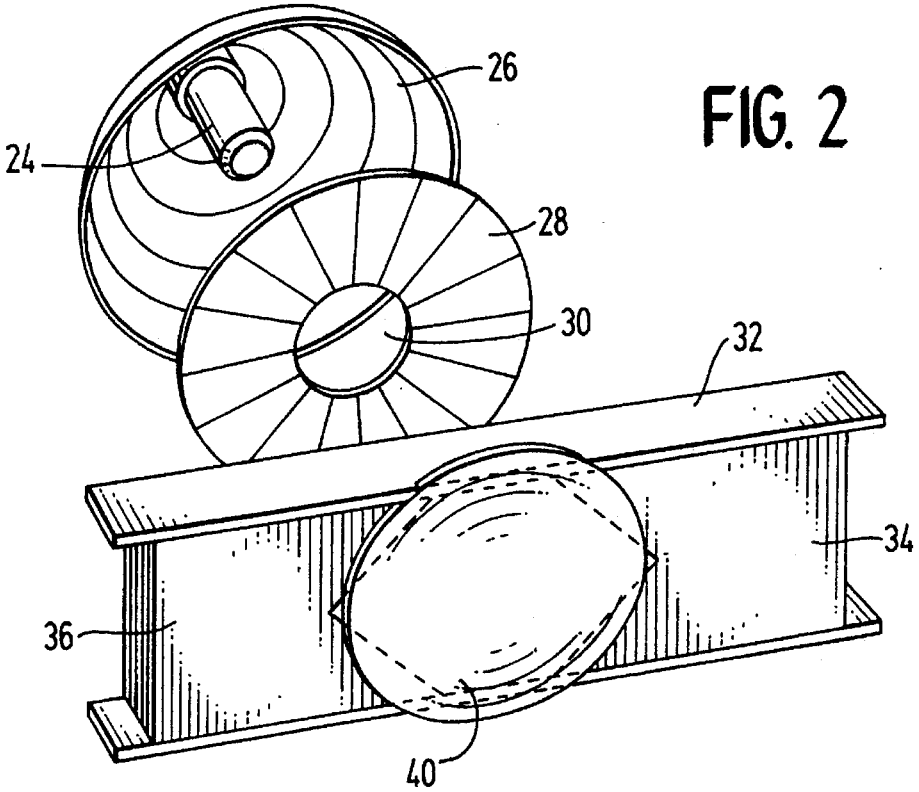
FIG. 2
FIG. 3
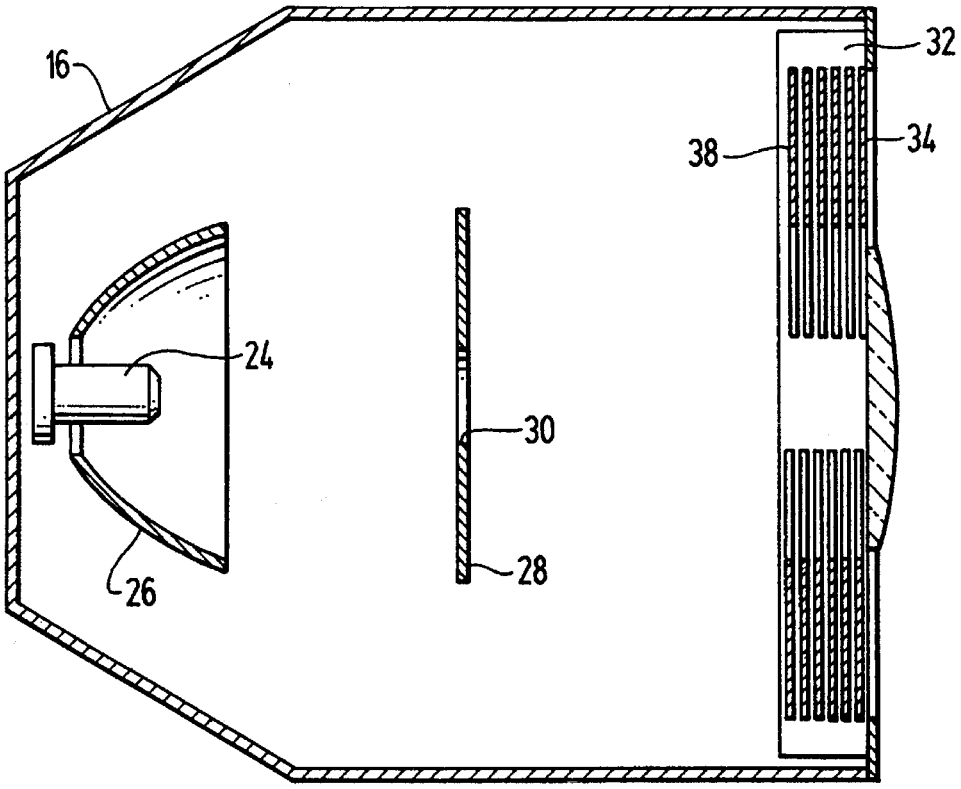

WASH LIGHT AND METHOD

CROSS-REFERENCE TO RELATED APPLICATIONS

This is a continuation-in-part of applications Ser. No. 08/350,094, filed on Nov. 29, 1994, abandoned and Ser. No. 08/383,892, filed on Feb. 6, 1995, abandoned.

BACKGROUND OF THE INVENTION

1. Field of the Invention

The present invention relates to a theatrical light and more particularly to a theatrical wash light which is compact and efficient.

2. Description of the Related Art

There are many existing wash light devices on the market today. However, they are not sufficiently efficient, nor bright enough or they lack certain capabilities that are desirable for wash lights in today's entertainment world. Hence, there is a continuing need for wash lights having greater brightness, lower weight, reduced size, increased reliability and enhanced ease of operation.

Numerous prior attempts to provide a superior wash light has yet to produce an optimal product.

BRIEF SUMMARY OF THE INVENTION

The difficulties encountered by previous wash lights have been overcome by the present invention. A compact wash light comprising a housing having a stationary portion, a yoke portion and an element enclosure portion; a high-powered halide discharge light source mounted within the enclosure portion of the housing for providing light; an elliptical reflector mounted within the enclosure portion of the housing for focusing the light and forming a light beam which defines an optical path; a light barrier having a fixed size aperture mounted downstream of the light source on the optical path and within the enclosure portion of the housing; an elongated compact frame mounted downstream of the light source and the light barrier on the optical path and within the enclosure of the housing for altering light from the light source; a plurality of dichroic filters, a dowser in the form of a panel and a plurality of diffusion panels in close proximity to one another mounted to the frame and slidable relative thereto, and an output lens mounted to the enclosure portion of the housing.

The invention also includes a method for assembling a wash light comprising the steps of forming a housing having a stationary portion, a yoke portion and an element enclosure portion; mounting a high-powered halide discharge light source within the enclosure portion of the housing for providing light; mounting an elliptical reflector within the enclosure portion of the housing for focusing the light and forming a light beam which defines an optical path; mounting a light barrier having a fixed size aperture downstream of the light source on the optical path and within the enclosure portion of the housing; mounting an elongated compact frame downstream of the light source and the light barrier on the optical path and within the enclosure portion of the housing; mounting a plurality of dichroic filters, a dowser in the form of a panel and a plurality of diffusion panels in close proximity to one another, to the frame in a sliding arrangement for altering light from the light source; and mounting an output lens to the enclosure portion of the housing.

An object of the present invention is to provide a wash light which is compact but fully capable. Another object of the present invention is to provide a wash light which is efficient and reliable.

A more complete understanding of the present invention and other objects, aspects, aims and advantages thereof will be gained from a consideration of the following description of the preferred embodiment read in conjunction with the accompanying drawings provided herein.

BRIEF DESCRIPTION OF THE SEVERAL VIEWS OF THE DRAWINGS

FIG. 2 is an diagrammatic isometric view of certain elements of the wash light with the housing removed.

FIG. 3 is a diagrammatic elevational view of a portion of the wash light.

DETAILED DESCRIPTION AND SPECIFICATION OF THE INVENTION

Figure 1:
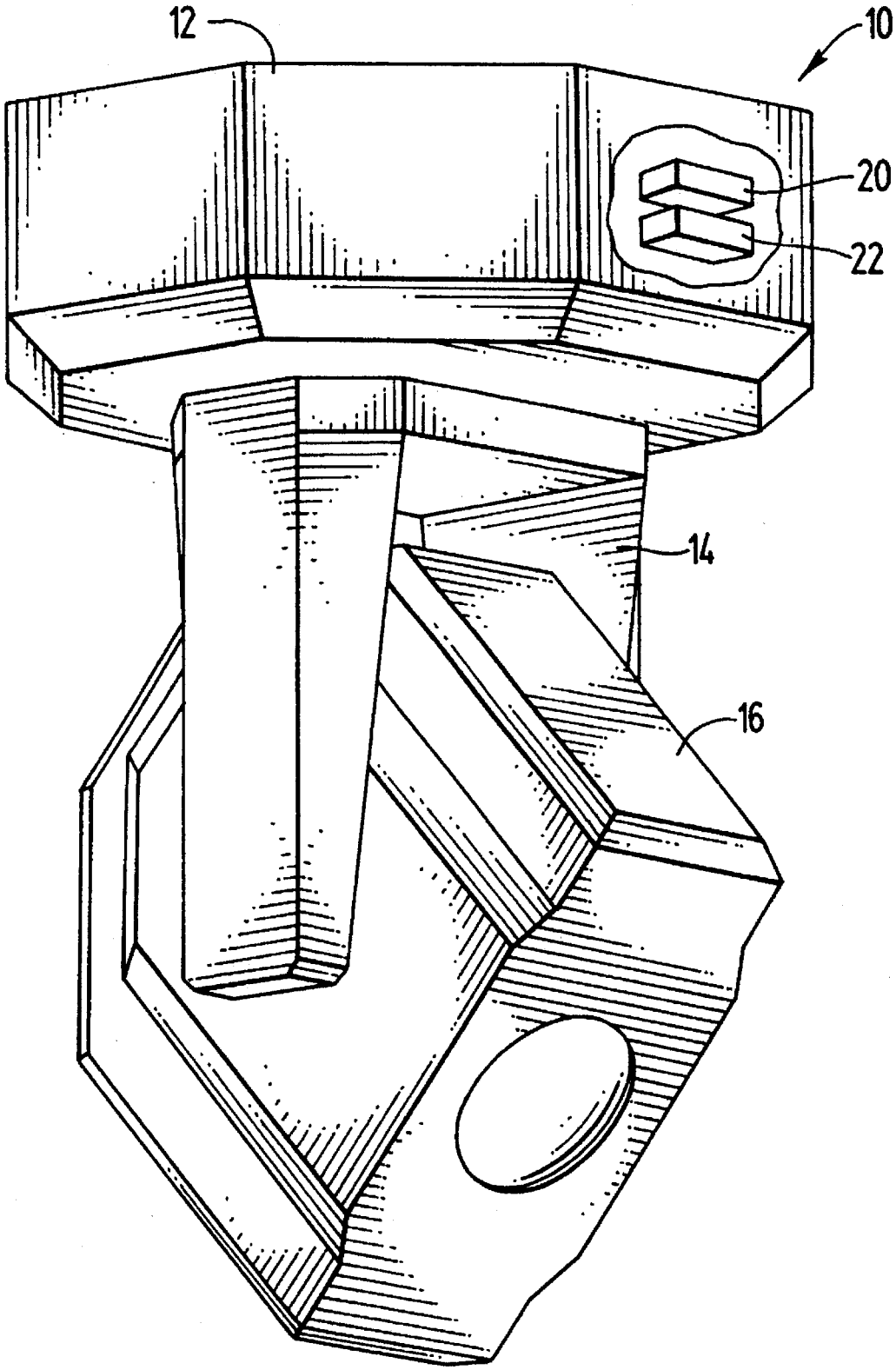
FIG. 1 is a diagrammatic isometric view, partially broken away, of the wash light of the present invention.

While the present invention is open to various modifications and alternative constructions, the preferred embodiment shown in the drawings will be described herein in detail. It is to be understood, however, that there is no intention to limit the invention to the particular form disclosed. On the contrary, the intention is to cover all modifications, equivalences, and alternative constructions falling within the spirit and scope of the invention as expressed in the appended claims.

Referring now to FIG. 1, a wash light 10 is shown as it would be when connected to a truss suspended over a stage to be lighted. The wash light includes a base 12 to be connected to the truss, such as by "J" clamps or the like (not shown), a yoke 14 mounted to the base to allow rotation through 360 degrees, and a housing 16 rotatably mounted to the yoke. Within the base is a ballast 20 and a main processor 22 for receiving signals from a computer to operate the light in a pre-selected fashion.

Referring now to FIGS. 2 and 3, the simplicity of the wash light 10 is shown by the nature and placement of its various elements. A light source such as a metal halide discharge lamp 24 is shown surrounded by a electro-formed elliptical reflector 26. The reflector focuses the light from the lamp 24 and creates a light beam which defines an optical path. The lamp of choice is an MSR 575. This allows the use of a compact, solid-state, square-wave, ballast 20. This size lamp also requires a minimum amount of cooling which helps reduce fan noise. Downstream from the lamp 24, and in the optical path, is a light barrier in the form of a field stop 28. The field stop includes a fixed one-inch diameter aperture 30. The purpose of the field stop is to block unwanted light and to define the size and shape of the "raw" beam.

Downstream of the field stop is a frame 32 holding a plurality of panels, such panel 34. The panel 34 and three of the other panels are dichroic filters preferably of the colors cyan, magenta and amber, as well as a color correction C.T.O. filter. The use of a variable C.T.O. filter gives a greater range of reds and pinks, as well as enhanced blue-green performance. This also allows the light to be utilized with standard incandescent fixtures as it can be color corrected to 3200 degrees Kelvin. These four panels and the frame form means for colorizing the light beam. The panels operate by sliding relative to the frame allowing one or more of the panels to move into the light beam and thereby change its color.

In addition to the sliding color filter panels, several of the panels, such as panel 36, are pieces of aluminum which acts as a mechanical dowser with gradient edge patterns to selectively block some or all of the light beam moving along the optical path. Several panels, such as panel 38, are for diffusion for modifying the light beam moving along the optical path. The dowser panels, diffusion panels and filter panels may be operated alone, or in various combinations, to provide a wide array of visual effects, and to allow the light beam to vary from a very narrow spot (referred to as "VNSP") to a wide beam (referred to as "WFL").

Immediately adjacent the frame 32 is a Fresnel output lens 40 used to widen the beam of light emanating from the housing.

Referring back to FIG. 1, the yoke 14 is mounted to the base 12 to allow 360 degree pan rotation. The housing 16 is mounted to the yoke 14 to allow 270 degrees of tilt movement. The yoke will be able to cover lock-to-lock excursion in two seconds or less, or as long as 9.99 minutes, if desired.

All of the elements: the lamp 24, the reflector 26, the field stop 28, the frame 32 with its panels, and the fernal lens 40 are mounted within the housing 16. The preferable structure will include a frame to which the elements are fastened, and the frame and the elements are enclosed by a sheet metal envelope.

In operation, the lighting system is hung from a truss above a stage and is programmed to move and light pre-selected areas of the stage in accordance with pre-selected instructions programmed into a computer. The system has the ability to be operated from any DMX 512 type console. Performance will depend on the console chosen. For best performance a sixteen bit control console such as the "Whole Hog" is desirable. Second choice is a twelve bit console such as the "Animator" or "Mark 2." The unit will also operate with an eight bit device for use on theatre desks.

The method for assembling a wash light comprises the relatively simple steps of providing a housing 16, mounting a light source 24 in the housing, mounting the reflector 26 around the lamp, situating the field stop 28 downstream of the lamp, mounting the frame 32 downstream of the field stop, placing a plurality of diffusion panels, dowser panels and color filters into the frame, and then mounting the lens 40 immediately adjacent to the panel whereby a compact and efficient wash light is formed.

We claim:

1. A compact wash light comprising:

a housing having a stationary portion, a yoke portion and an element enclosure portion;

a high-powered halide discharge light source mounted within said enclosure portion of said housing for providing light;

an elliptical reflector mounted within said enclosure portion of said housing for focusing said light and forming a light beam which defines an optical path;

a light barrier having a fixed size aperture mounted downstream of said light source on said optical path and within said enclosure portion of said housing;

an elongated compact frame mounted downstream of said light source and said light barrier on said optical path and within said enclosure portion of said housing for altering light from said light source;

a plurality of dichroic filters, a dowser in the form of a panel and a plurality of diffusion panels in close proximity to one another mounted to said frame and slidable relative thereto; and an output lens mounted within said enclosure portion of said housing.

2. A compact wash light as claimed in claim 1 wherein;

said enclosure portion of said housing has, when viewed in a direction parallel to the optical path, an elongated shape.

3. A compact wash light as claimed in claim 1 wherein said enclosure portion of said housing is mounted to said yoke to provide said enclosure portion 360° of pan and about 270° of tilt.

4. A compact wash light as claimed in claim 1 including:

means connected to said housing for receiving signals from a computer whereby said enclosure portion of said housing may be moved in a controlled manner.

5. A compact wash light as claimed in claim 1 wherein:

said dowser panel is made of aluminum.

6. A compact wash light as claimed in claim 5 including:

means connected to said housing for receiving signals from a computer whereby said enclosure portion of said housing may be moved in a controlled manner; and wherein said enclosure portion of said housing has, when viewed in a direction parallel to the optical path, an elongated shape; and said enclosure portion of said housing is mounted to said yoke to provide said enclosure portion 360° of pan and about 270° of tilt.

7. A method for assembling a compact wash light comprising the steps of:

forming a housing having a stationary portion, a yoke portion and an element enclosure portion;

mounting a high-powered halide discharge light source within said enclosure portion of said housing for providing light;

mounting an elliptical reflector within said enclosure of said housing for focusing said light and forming a light beam which defines an optical path;

mounting a light barrier having a fixed size aperture downstream of said light source on said optical path and within said enclosure portion of said housing;

mounting an elongated compact frame downstream of said light source and said light barrier on said optical path and within said enclosure portion of said housing;

mounting a plurality of dichroic filters, a dowser in the form of a panel and a plurality of diffusion panels in close proximity to one another, to said frame in a sliding arrangement for altering light in said optical path; and mounting an output lens to said enclosure portion of said housing.

8. A method as claimed in claim 7 including the step of:

mounting means in said housing for receiving signals from a computer.

* * * * *